US005393011A

United States Patent [19]

Dunn et al.

[11] Patent Number: 5,393,011

[45] Date of Patent: Feb. 28, 1995

[54] CONTROL SYSTEMS FOR MOVING BODIES

[75] Inventors: Albert J. Dunn, Bangor; Oliver S. Carson, Belfast, both of Northern Ireland

[73] Assignee: Shorts Missile Systems Limited, Belfast, Northern Ireland

[21] Appl. No.: 512,822

[22] Filed: Dec. 3, 1965

[51] Int. Cl.[6] ..... F42B 10/60

[52] U.S. Cl. ..... 244/3.21

[58] Field of Search ..... 244/3.11, 3.14, 3.15, 244/3.16, 3.17, 3.19, 3.2, 3.23

[56] References Cited

U.S. PATENT DOCUMENTS

| | | | |
|---|---|---|---|
| 3,067,681 | 12/1962 | Beman | 244/3.23 |
| 3,111,088 | 11/1963 | Fisk | 244/3.23 |
| 3,154,015 | 10/1964 | Muller | 244/3.21 |

*Primary Examiner*—Ian J. Lobo

*Attorney, Agent, or Firm*—Cushman Darby & Cushman

[57] ABSTRACT

Disclosed herein is a missile having a rotatable portion arranged for rotation relative to another portion of the missile which contains spacedly mounted electromagnetic coils for respectively operating first and second control member actuator mechanisms for controlling the missile.

10 Claims, 2 Drawing Sheets

CONTROL SYSTEMS FOR MOVING BODIES

The present invention relates to control systems for moving bodies and is particularly though not exclusively concerned with a control system for an aerial body such as a missile.

In our copending U.S. application Ser. No. 373,881 still pending filed Jun. 9, 1964 there is claimed a missile comprising a rotatable portion arranged for rotation relative to another portion of the missile, means for rotating said rotatable portion and bringing it to any one of a number of preselected positions in relation to a datum, and means on said rotatable portion for exerting a thrust thereon away from the axis of rotation to produce a steering effect on the missile.

According to the present invention, there is provided a missile or other moving body comprising a rotatable portion arranged for rotation about a predetermined axis relative to another portion of the missile or body, first and second control members on said rotatable portion for separate actuation by first and second actuator mechanisms movable in response to the energisation of first and second electromagnetic coils forming part of the mechanisms and contained in the said other portion of the missile or body, said coils being mounted in spaced relation in the said other portion along the rotary axis of said rotatable portion and concentric with respect thereto, with the first coil nearer to the rotatable portion than the second coil, the first actuator mechanism comprising an axially movable sleeve coaxial with the rotary axis and extending at one end into the rotatable portion and at the other end carrying an armature disc mounted concentrically with respect to the sleeve and in cooperating relation with the first coil which upon energisation causes the disc and the sleeve to move axially, to effect actuation of the first control member and the second actuator mechanism comprising an axially movable shaft coaxial with the rotary axis and slidable within the sleeve, said shaft extending beyond said sleeve at each end, one end of the shaft extending into the rotatable portion of the missile or body and the other end carrying a further armature disc concentric with the shaft and arranged in cooperating relation with the second coil which upon energistation causes the further disc and the shaft to move axially along the rotary axis of the rotatable portion to effect actuation of the second control member.

The sleeve and its associated armature disc as well as the shaft and its associated disc may be rotatable about the rotary axis of the rotatable portion of the missile, but in a preferred embodiment of the invention although capable of rotation the latter are not required to rotate with the rotatable portion, and a spool is provided on the end of the shaft and a further spool provided on the end of the sleeve, each spool being coaxial with the rotary axis of the rotatable portion and being engaged by a pin which slides in a peripheral groove in the spool and is constrained to follow the axial displacement of the spool whilst rotating with the rotatable portion.

In an embodiment of the invention hereinafter to be described, the spools are rotatably mounted on the ends of the shaft and sleeve so that they may turn with the rotatable portion and remain stationary with respect to their cooperating pins.

One embodiment of the invention will now be described by way of example with reference to the accompanying drawings in which.

Figure 1:
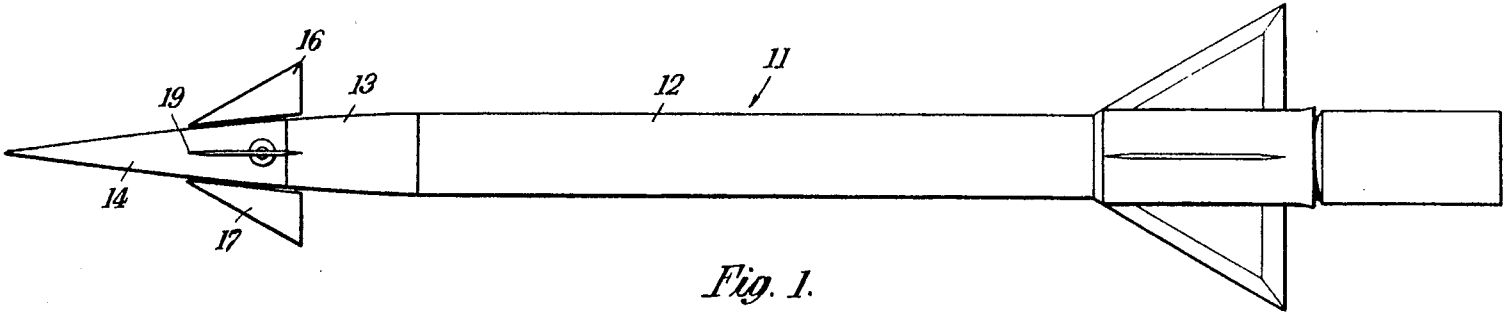
FIG. 1 is a side elevation of a missile according to the invention.
Figure 2:
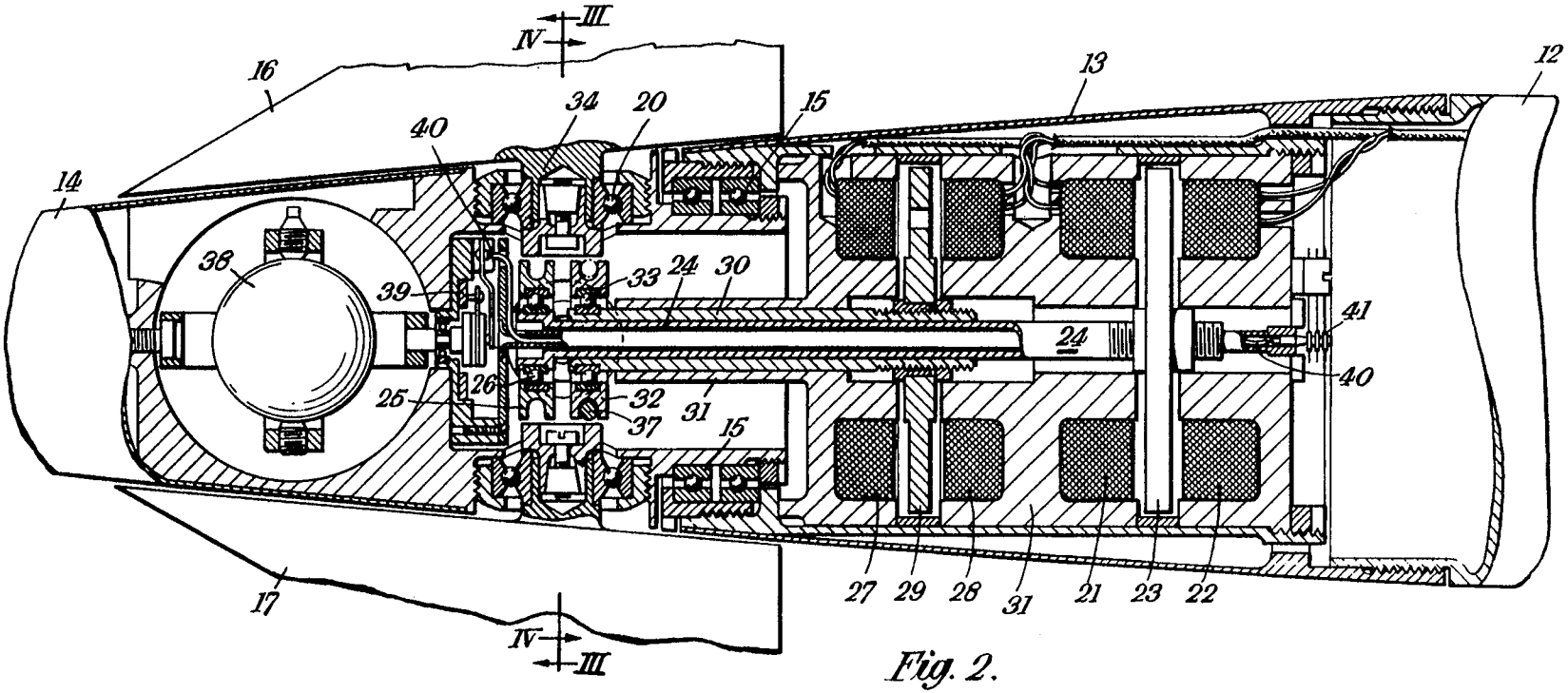
FIG. 2 is a part-sectional side elevation of a forward portion of the missile shown in FIG. 1, drawn to a larger scale.

Referring to the drawings, a missile 11 comprises a main body portion 12, a fixed nose portion 13 which is screwed on to the main body portion 12, and a rotatable nose portion 14 which is rotatably mounted on bearings 15 for rotation about the longitudinal axis of the missile. The rotatable nose portion 14 includes a pair of elevator control surfaces 16 and 17 and a pair of aileron control surfaces 18 and 19. The control surface 16 is rotatably mounted in bearings 20 for rotation about an axis passing through the longitudinal axis of the missile and at right angles thereto and each of the other control surfaces 17, 18 and 19 are likewise rotatably mounted in the rotatable nose portion 14. The elevator control surfaces 16 and 17 have a common pivotal axis and are arranged to be pivoted about this axis by an actuator mechanism comprising a pair of solenoid coils 21 and 22 which are arranged coaxially on the longitudinal axis of the missile and are spaced apart so as to receive in the gap between them an armature disc 23 which is fixedly mounted on the rear end of a hollow shaft 24 lying on the longitudinal axis of the missile and extending forwardly into the rotatably nose portion 14 and terminating at the forward end in a spool 25 rotatably mounted thereon in bearings 26 and the solenoid coils 21 and 22 are so wound and adapted to be alternately energised that the armature disc 23 is pulled within the gap to the one or other of the coils and causes a longitudinal displacement of the shaft 24 and a corresponding displacement of the spool 25.

The aileron control surfaces 18 and 19 are likewise pivotal about a common lateral axis and are controlled by an actuator mechanism comprising a pair of solenoid coils 27 and 28 fixedly mounted in spaced relation in the fixed nose portion 13 and coaxial with the longitudinal axis of the missile and an armature disc 29 concentric with the coils and arranged in the gap between them. The disc 29 is fixedly mounted on the end of a sleeve 30 within which the hollow shaft 24 is slidably and rotatably mounted, and the sleeve 30 is itself slidably and rotatably mounted in a supporting framework 31 of the fixed nose portion 13 and projects at its forward end into the rotatable nose portion 14, terminating in a spool 32 rotatably mounted on its forward end in bearings 33. The solenoid coils 27 and 28 are likewise so wound and energised alternately that the armature disc 29 is pulled within the gap to the one or the other of the coils and causes a longitudinal displacement of the sleeve 30 and a corresponding displacement of the spool 32.

Figure 3:
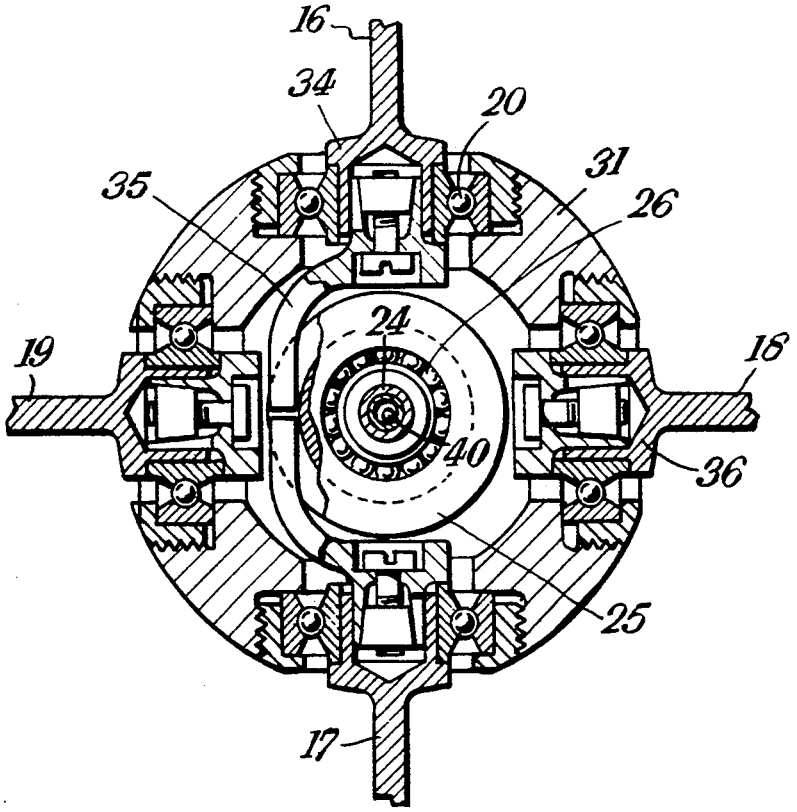
FIG. 3 is a sectional end elevation taken on the line III—III in FIG. 2.

Referring particularly to FIG. 3, the elevator control surface 16 is provided with an inwardly extending boss 34 which carries a curved pin 35 which engages in the peripheral groove in the spool 25, and elevator control surface 17 is likewise provided with a bush and curved pin the latter of which engages in the groove in the spool 25 on the same side as that of the pin 35 so that longitudinal displacement of the spool 25 results in a pivoting movement of the control surfaces 16 and 17 in the same sense.

Figure 4:
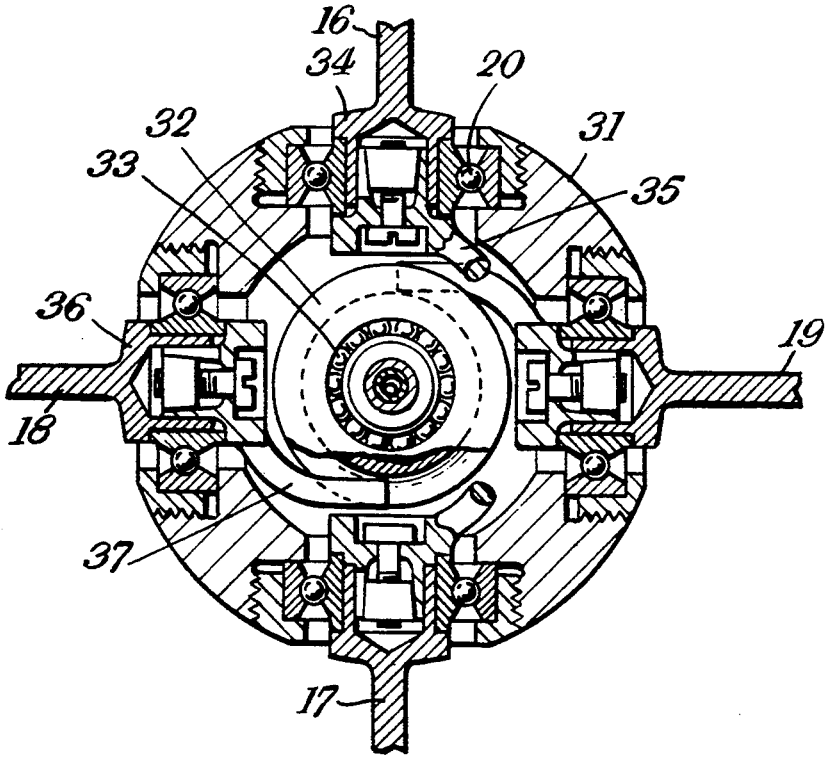
FIG. 4 is a sectional and elevation taken on the line IV—IV in FIG. 2.

Referring particularly to FIG. 4, the aileron control surface 18 is provided with an inwardly directed boss 36 carrying a curved pin 37 which is arranged to engage in the peripheral groove in the spool 32 and the aileron control surface 19 is likewise provided with a bush and curved pin the latter of which is arranged to engage in the groove in the spool 32 on the side opposite that engaged by the pin 37 so that displacement of the spool 32 along the longitudinal axis of the missile results in a pivoting movement of the control surfaces 18 and 19 in opposite senses.

The rotatable nose portion of the missile carries a free gyroscope 38 which is arranged to generate signals representative of the roll attitude of the nose portion 14, on a potentiometer 39 and these signals are fed along a signal carrying lead 40 which passes through the hollow shaft 24 to a slip ring assembly 41.

In the control system described and claimed in our copending above-mentioned U.S. patent application Ser. No. 373,881 still pending, signals for controlling the operation of the elevator and aileron control surfaces are transmitted from a ground station and received by a receiver mounted in the main body 12 of the missile, and these signals are employed to operate switches for alternately energising the coils 21, 22, 27 and 28 and the control is made such that the aileron control surfaces 18 and 19 are first operated to bring the rotatable nose portion to a predetermined roll attitude in space and the elevator control surfaces 16 and 17 subsequently operated to produce a lateral steering thrust on the missile.

What we claim as our invention and desire to secure by letters patent is:

1. A moving body comprising:

a rotatable portion arranged for rotation about a predetermined axis relative to another portion of the body, first and second control members on said rotatable portion for separate actuation by first and second actuator mechanisms movable in response to the energisation of first and second electromagnetic coils forming part of the mechanisms and contained in the said other portion of the body, said coils being mounted in spaced relation in the said other portion along the rotary axis of the said rotatable portion and concentric with respect thereto, with the first coil nearer to the rotatable portion than the second coil, the first actuator mechanism comprising an axially movable sleeve co-axial with the rotary axis and extending at one end into the rotatable portion and at the other end carrying an armature disc mounted concentrically with respect to the sleeve and in cooperating relation with the first coil which upon energisation causes the disc and the sleeve to move axially to effect actuation of the first control member, and the second actuator mechanism comprising an axially movable shaft coaxial with the rotary axis and slidable within the sleeve, said shaft extending beyond said sleeve at each end, one end of the shaft extending into the rotatable portion of the body and the other end carrying a further armature disc concentric with the shaft and arranged in cooperating relation with the second coil which upon energisation causes the further disc and the shaft to move axially to effect the second control member.

2. A body according to claim 1, wherein the sleeve and the associated armature disc as well as the shaft and its associated armature disc are rotatable about the rotary axis of the rotatable portion of the body.

3. A body according to claim 1, wherein a spool is provided on the end of the shaft and a further spool on the end of the sleeve each spool being co-axial with the rotary axis of the rotatable portion and being engaged by a pin which is carried by the associated control member, said pin being in sliding engagement in a peripheral groove in the spool and being constrained thereby to follow the axial displacement of the spool whilst rotating with the rotatable portion.

4. A body according to claim 3, wherein the spools are rotatably mounted on the ends of the shaft and sleeve.

5. A body according to claim 3, wherein said first and second members are first and second aerodynamic control surfaces pivotally mounted on the rotatable portion of the body for pivotal movement about lateral axes and wherein the pin engaging one of the spools is carried by a supporting shaft for one of the control surfaces in such a manner that axial displacement of the spool causes a pivotal turning movement of the control surface, and wherein the pin engaging the spool is carried by a supporting shaft for the other control surface in such a manner that axial displacement of the spool causes a pivotal turning movement of the said other control surface.

6. A body according to claim 5, wherein the first control surface serves as an elevator in cooperation with a third control surface arranged on the rotatable portion for pivotal movement about the same lateral axis as the first control surface, and wherein the third surface carries a pin which engages in the groove in the spool engaged by the pin actuating the first control surface, on the same side of the spool as the pin actuating the first control surface, the arrangement being such that axial displacement of the spool causes a pivotal turning movement of the first and third control surfaces in the same sense.

7. A body according to claim 6, wherein the second control surface serves as an aileron in cooperation with a fourth control surface arranged on the rotatable portion for pivotal movement about the same lateral axis as the second control surface, and wherein the fourth control surface is arranged to carry a pin which engages in the groove in the spool engaged by the pin actuating the second control surface, on the side of the spool opposite to that engaged by the pin actuating the second control surface, the arrangement being such that an axial displacement of the spool causes pivotal turning movement of the second and fourth control surfaces in opposite senses.

8. A body according to claim 1, wherein said shaft is hollow and wherein an electrical lead is arranged to pass through the hollow shaft for conducting electrical current between the rotatable portion and the other portion of the body.

9. A body according to claim 8, wherein said rotatable portion includes a space-stabilised gyroscope adapted to generate an electrical signal representative of the roll attitude of the rotatable portion with respect to a datum attitude, and wherein said signal is conducted to the said other portion of the body by said electrical lead.

10. A body according to claim 1 wherein said body is a missile.

* * * * *